US010708983B2

(12) United States Patent
Meichtry et al.

(10) Patent No.: US 10,708,983 B2
(45) Date of Patent: Jul. 7, 2020

(54) METHOD AND DEVICE FOR REMOVING DENTS

(71) Applicant: Ralph Meichtry, Feusisberg (CH)

(72) Inventors: Ralph Meichtry, Feusisberg (CH); Beat Basler, Horgen (CH); Ivan Kouba, Prague (CZ)

(73) Assignee: Ralph Meichtry, Feusisberg (CH)

( * ) Notice: Subject to any disclaimer, the term of this patent is extended or adjusted under 35 U.S.C. 154(b) by 298 days.

(21) Appl. No.: 15/820,099

(22) Filed: Nov. 21, 2017

(65) Prior Publication Data

US 2018/0103512 A1 Apr. 12, 2018

Related U.S. Application Data

(63) Continuation of application No. 14/455,562, filed on Aug. 8, 2014, now Pat. No. 9,826,577.

(51) Int. Cl.

| | |
|---|---|
| ***H05B 6/00*** | (2006.01) |
| ***H05B 6/10*** | (2006.01) |
| ***B21D 1/06*** | (2006.01) |
| ***B21D 26/14*** | (2006.01) |

(52) U.S. Cl.
CPC ..... *H05B 6/101* (2013.01); *B21D 1/06* (2013.01); *B21D 26/14* (2013.01)

(58) Field of Classification Search
CPC ..... H05B 6/101; B21D 1/06; B21D 26/14
USPC ..... 219/602
See application file for complete search history.

(56) References Cited

U.S. PATENT DOCUMENTS

| | | | | |
|---|---|---|---|---|
| 3,318,127 | A * | 5/1967 | Astleford, Jr. | B21D 26/14 72/56 |
| 3,345,844 | A * | 10/1967 | Jansen | B21D 26/14 72/56 |
| 3,816,690 | A * | 6/1974 | Mittelmann | G01R 21/00 219/663 |
| 3,959,619 | A * | 5/1976 | Schill | B21D 1/06 219/50 |
| 3,998,081 | A * | 12/1976 | Hansen | B21D 1/06 72/56 |
| 4,116,031 | A * | 9/1978 | Hansen | B21D 1/08 72/56 |

(Continued)

FOREIGN PATENT DOCUMENTS

| | | |
|---|---|---|
| DE | 39 27 432 A1 | 2/1991 |
| DE | 43 43 578 A1 | 6/1995 |

(Continued)

OTHER PUBLICATIONS

"Magnetic Fields Pop Dents", 903 Machine Design, Cleveland, Ohio, USA, vol. 68, No. 2, Jan. 25, 1996, p. 42.

*Primary Examiner* — Viet Le
(74) *Attorney, Agent, or Firm* — Pauley Erickson & Kottis

(57) ABSTRACT

The invention is directed to a dent removing device for removing of dents in ferromagnetic sheet metals by way of inductive heating, said dent removing device comprising a working head with a housing with at least one working face foreseen to be brought in close contact with a dent in a sheet metal and at least one magnetic field generator for generating a magnetic field. According to the invention, the at least one working face comprises a recess for visual control of the dent removing, recess extending at least partially across the at least one working face.

13 Claims, 3 Drawing Sheets

(56) References Cited

U.S. PATENT DOCUMENTS 4,127,933 A * 12/1978 Hansen ..... H01F 41/04 29/605
4,135,379 A * 1/1979 Hansen ..... B21D 1/06 29/419.2
4,355,222 A 10/1982 Geithman et al.
4,378,548 A * 3/1983 Rybak ..... H01F 7/206 335/291
4,754,637 A * 7/1988 O'Dell ..... B21D 1/06 72/430
4,962,292 A * 10/1990 Aoki ..... H05B 6/062 219/663
4,986,102 A * 1/1991 Hendrickson ..... B21D 1/06 72/56
5,046,345 A * 9/1991 Zieve ..... B21D 1/06 361/155
5,248,865 A * 9/1993 Tyler ..... H05B 6/10 219/642
5,266,764 A * 11/1993 Fox ..... H05B 6/362 156/272.2
5,660,753 A * 8/1997 Lingnau ..... B08B 7/0071 134/17
5,730,016 A * 3/1998 Zittel ..... B21D 26/14 72/430
6,043,471 A * 3/2000 Wiseman ..... H05B 6/06 219/662
6,050,121 A * 4/2000 Daehn ..... B21D 1/06 72/430
6,563,096 B1 * 5/2003 Pacholok ..... H05B 6/101 219/635
6,684,677 B1 * 2/2004 Bar ..... B21D 1/06 72/342.1
6,794,622 B1 * 9/2004 Alveberg ..... B08B 7/0071 219/635
7,078,993 B2 * 7/2006 Berg ..... B21D 1/06 335/299
7,607,332 B2 * 10/2009 Choe ..... B23K 20/023 72/342.6
2004/0168495 A1 * 9/2004 Berg ..... B21D 1/06 72/56
2008/0034829 A1 * 2/2008 Choe ..... B23K 20/023 72/342.6
2008/0163661 A1 * 7/2008 Meichtry ..... B21D 1/06 72/56
2016/0044748 A1 * 2/2016 Meichtry ..... B21D 26/14 219/602

FOREIGN PATENT DOCUMENTS

EP 2 085 161 A1 8/2009
FR 1419497 A 11/1965
WO WO 99/48334 A1 9/1999
WO WO 01/10579 A1 2/2001
WO WO 01/30117 A1 4/2001
WO WO 2006/119661 A1 11/2006

* cited by examiner

METHOD AND DEVICE FOR REMOVING DENTS

CROSS-REFERENCE TO RELATED APPLICATIONS

This application is a continuation of U.S. patent application Ser. No. 14/455,562, filed on 8 Aug. 2014, issuing as U.S. Pat. No. 9,826,577 on 21 Nov. 2017. The co-pending parent application is hereby incorporated by reference herein in its entirety and is made a part hereof, including but not limited to those portions which specifically appear hereinafter.

BACKGROUND OF THE INVENTION

Field of the Invention

The present invention relates to a method and a device for removing dents in ferromagnetic sheet metal structures by inductive heating.

Discussion of Related Art

WO 2006/119661 in the name of Ralph Meichtry discloses a method and a device for removing dents in a sheet metal structure based on electromagnetic energy. The device comprises a working head which is interconnected to a power device by a connecting cable. For the removal of dents, the working head is positioned in the area to be treated and brought into contact with the sheet metal. During operation a relative force is established between the working head and the surface to be treated.

EP2085161 in the name of Karel Mazac and Paul Schuller is related to a method and device for removing dents by inductive heating in combination with an applied electromagnetic force. According to the document, an indented region of sheet metal structure is covered by a working head, heated by inductive heating and subsequently pulled outside by magnetic force. In order to determine the progress of dent removal, the document proposes to use a mechanical measuring bolt.

WO 01/10579 in the name of Advanced Photonics Technologies AG discloses a method and device for removing a dent from sheet metal parts. Therefore, a sheet metal part is locally heated by a lamp. The heating takes place in an essentially contactless manner with the aim to cause a mechanical stress gradient which effects the dent to straighten back. The document mentions the application of heat by targeted application of radiation, by an inductive means or by a directed stream of hot air. The device described in detail comprises a hood with a lamp and a reflector that may have a peripheral opening. According to the document, the region of the dent may be observed through the opening when the hood has been put in place.

SUMMARY OF THE INVENTION

It is an object of this invention to provide an improved method and a thereto related device for the removal of dents in ferromagnetic sheet metal structures which can be operated more user-friendly and efficiently.

It is known that some types of dents in sheet metal structures can be removed by local inductive heating and thereto related local thermal expansion. Therefore, a working face of an inductive heating device is positioned adjacent to a sheet metal structure and subsequently an alternating magnetic field is applied to the sheet metal. The magnetic field is generated by a coil arranged in the inductive heating device. Said alternating magnetic field generates eddy currents within the sheet metal structure that, due to the resistance of the metal, cause resistive heating of the metal in the operating area of the inductive heating device.

In order to ensure efficient and controlled local heating of the sheet metal structure, an inductive heating device will usually be as close as possible, i.e. if possible in direct contact to the sheet metal structure to be treated. Controlled heating is very important in order to avoid damage to the sheet metal structure itself or to a finish coating such as paint which may be present.

In an embodiment of the present invention, a working head for removing dents in sheet metal structures by inductive heating comprises a housing which has a top portion and a bottom portion. The working head further comprises a working face which is arranged at the bottom portion of the housing. The working face is suited to be brought at least partially into contact with a sheet metal structure for removing a dent. If appropriate, the working face may have a substantially rectangular shape. For some applications, the working face may also have a circular or elliptical shape. The working face may have a substantially flat surface or a curved surface, e.g. depending on the shape of the sheet metal structure to be treated.

A working head normally comprises a magnetic field generator arranged in the housing. If preferred, a working head may comprise a first connector arranged at the housing in order to connect the working head to a power supplying cable in order to supply electrical signals to the working head. Alternatively or in addition, a cable may also be an integral part of the working head, hence be permanently connected to it. Different power supply devices supplying AC-current may be applied to supply the power to the working head.

For optical control of the surface and the result of the treatment sided light is applied. Nowadays with the devices known from the prior art, it is difficult to visually control the process of inductive dent removal as during the treatment the dent itself is covered by the inductive heating device and therefore the sided light is not visible. Hence, a user of such a device does not know for sure if the dent removal process was successful prior to removing the heating device from the sheet metal structure. Therefore, for visual control of the process, the bottom portion of the housing may comprise at least one recess which is preferably arranged in lateral direction and extends in the working face. The at least one recess allows visual inspection of the area being inductively heated during a dent removal process as the sided light remains visible to an operator of the device.

A dent removing device for removing of dents in ferromagnetic sheet metals by way of inductive heating comprises a working head with a housing with at least one working face foreseen to be brought in close contact with a dent in a sheet metal and at least one magnetic field generator for generating a magnetic field. According to the invention, the at least one working face comprises a recess for visual control of the dent removing process, said recess extending at least partially across the at least one working face. Good results may be achieved if the recess extends persistent across the working face and divides the working face into at least two sections. Alternatively or in addition, the at least one magnetic field generator at least partially follows the contour of the recess. If preferred, the magnetic field generator comprises an electrical coil. For some purposes the magnetic field generator may comprise a substantially U-shaped core, said core comprising a first and a second leg and a yoke portion and at least one electrical coil is interconnected to the core. Good results may be achieved if the recess has a V- or U-shaped cross section. In a variant of the invention, the recess may have a constant or variable cross section. Alternatively or in addition, the working head may comprise more than one working face. In a variant of this aspect of the invention, each working face may comprise a thereto related magnetic field generator. If preferred, each working face may have a differently shaped recess. If appropriate, an activating means may be arranged at the housing, said activating means being suited to control the magnetic field. Further details will be described in detail below.

In an embodiment of the invention, the recess is understood as an interruption in the working surface of the working head. A recess therefore may extend between two side faces and the working face of a housing. Good results may be achieved if the recess extends to the central region of the working surface, as in many cases a working head will be positioned centered over a dent. A recess which extends between two side faces of a housing may for some applications be advantageous as it will allow visual inspection from two sides of the working head. Preferably inside of the working head at least one coil for inductive heating closely follows the contour of the recess in the housing. If appropriate, the recess may be empty or may be filled with an optically transparent material.

During operation the working head is positioned at the area where the dent is located such that the recess is positioned over the dent allowing visual inspection. The coil is positioned adjacent to the dent. As the recess provides visual control of the critical areas, the user may observe the progress of the dent removal during inductive heating as the sided light, if present, remains visible. Hence, the dent removal process can be controlled more precisely and more efficiently. Thus, the recess serves as a viewing window, so that the dent to be removed is not covered by the working head during removing process. Alternatively or in addition, a light source may be arranged at or incorporated into the working head in order to facilitate and improve the visual inspection of a dent being treated. Therefore, the light source may be arranged in or adjacent to a recess in the bottom portion of the housing.

In addition, a working head may comprise magnetic elements which may be used in order to temporary fix the working head to the work piece, e.g. the sheet metal structure. This may be advantageous when the operator simultaneously wants to work on the opposite (convex) side of the dent of the damaged part. Depending on the field of application, permanent and/or non-permanent magnets may be used.

Good results may be achieved if the recess is V-shaped or U-shaped. However, a working head may also comprise grooves with other shapes. If appropriate, the recess may divide the working face into two sections. If more than one recess is arranged on the bottom portion of the housing, the working face may be divided into more than two sections.

In a variation of the invention, the working head comprises more than one working face. For example, a working head may comprise a first working face comprising a first recess as described above, allowing visual control of the dent removal process. Alternatively or in addition, the working head may comprise a second working face which is e.g. flat and allows very efficient heating. The second working face normally can have a different or the same size compared to the first working face. Alternatively or in addition, the working head may comprise a working face with a second recess having a differently shaped recess, e.g. being larger or smaller than the first recess. Inside of the housing, each working face has a thereto related coil which is preferably adopted in size, shape and position to the size of the thereto related working face. Each working face may comprise its own control means or being controlled by the same control means. Activation of a working face may take place by an appropriate switch. The top portion and the bottom portion of the housing of a working head may have a similar shape. For some purposes, the cross section of the bottom portion may have a smaller cross-section than the top portion. Such embodiments of a working head may allow to concentrate induced heating to the dent and reduce the risk of damage and/or to reduce the size of the working face.

If appropriate, an activating means may be arranged at the housing of a working head, said activating means being suited e.g. to turn on the magnetic field. Such an activating means arranged at the housing of a working head may be advantageous as thus the heating process may be activated or deactivated by operating the activating means without disconnecting the electrically power supply to the working head. This provides a safe and user-friendly use of the working head. In addition, it may allow a user to operate the working head with a single hand. Alternatively or in addition, an activating means may also be arranged separately from the housing and be operatively connected to the working head. For example, an activating means operatively connected to the working head may be placed on the floor and be operated by a foot.

If appropriate, an activating means may be a button, allowing different operating modes. In a variant, a user presses the button to turn on the magnetic field generator and keeps pressing the button until the magnetic field generator should be turned off. Depending on the embodiment of the invention, alternatively or in addition, the user can press the button to turn on the magnetic field generator and releases the button without turning off the magnetic field generator and press the button again to turn off the magnetic field generator.

If appropriate, a vibration generating means and/or acoustic signal generator and/or visual display unit may be arranged in the housing. The vibration generating means may generate vibration, which may be related to the operating state of the magnetic field generator. If appropriate, vibration may be generated in a synchronal manner with the turning on the magnetic field generator. Vibration may also be used to indicate a user that the inductive heating process is active. If present, an acoustic generator may generate acoustic signals in order to indicate malfunctioning or other errors. Alternatively or in addition, a visual display unit may be provided for indicating e.g. errors or operating parameters. A visual display unit may also comprise a light source, such as a L.E.D.

Good results may be achieved if the magnetic field generator comprises a substantially U-shaped core with a first and a second leg and a yoke (base) portion. In such embodiments of the invention, a recess may extend between the first and second leg in a direction that is substantially perpendicular to the plane defined by the first and second leg. In some embodiments, the first and/or second leg may have a cross-section with a minimum diameter of between 4 and 10 mm, preferably between 6 and 9 mm. Such an embodiment of a working head will allow highly concentrated heating.

A device for removing dents in sheet metal structures by inductive heating may comprise a working head, a power supply and control unit and a cable suited to connect the power supply and control unit with the working head. Any embodiments of the working head mentioned in the present invention may be applied for such a device. The power supply and control unit may comprise a time regulation means to control the duration of supplying the power to the working head. Alternatively or in addition, it may also comprise a power regulation means to control the power supplied to the working head. Such a power supply and control unit will provide the electrical power supplied to the working head, mainly for the magnetic field generator but also for e.g. the visual display unit or vibration generator or other elements being electrically driven. The time regulation means is provided to control the duration of supplying the electrical power to the working head. Controlling the duration of supplying electrical power to the working head allows controlling maximum heating, which is necessary in order to prevent thermal damage to the metal sheet structure or a surface finish. The power regulation means is provided to control the power provided to the working head, in particular the power provided to the magnetic field generator. Thus, the strength of the generated magnetic field and consequently also the induced eddy currents, respectively the power of the induced heating, can be controlled. Heating with low power will in general cause slower heating and hence also more large-area heating due to the thermal dissipation caused by thermal conduction within the sheet metal structure. In contrast, heating with high power will in general cause more localized heating. Hence, the size of the area which has to be heated can be controlled to a certain extent by power regulation means. A power supply with such means for power and time control may also be used for other applications, e.g. in combination with working heads that have no recess.

In some embodiments, the time regulation means may be set in a range of between 0.5 seconds and infinity (continuous power supply).

For some applications a working head for a device for dent removal may also comprise active and/or passive cooling means. Passive cooling elements may comprise cooling fins. Active cooling means may comprise the exchange of a cooling agent and/or thermoelectric cooling, as e.g. provided by Peltier elements. Such cooling means may be arranged at the working surface in order to prevent overheating of the working head and/or the sheet metal structure. Alternatively or in addition, a cooling means may be used in order to obtain high thermal gradients and consequently also stress gradients even at relatively low induced temperatures.

Moreover, the present invention is directed to a method for removing dents in sheet metal structures by inductive heating. The method comprises positioning a working head on a sheet metal structure, setting a time regulation means and/or a power regulation means of a power device, activating an activating means of the working head, observing the sheet metal structure through a recess arranged on the working head and repeating all the steps, if necessary.

BRIEF DESCRIPTION OF THE DRAWINGS

The herein described invention will be more fully understood from the detailed description given herein below and the accompanying drawings which should not be considered limiting to the invention described in the appended claims. The drawings are showing:

DESCRIPTION OF PREFERRED EMBODIMENTS

Figure 1:
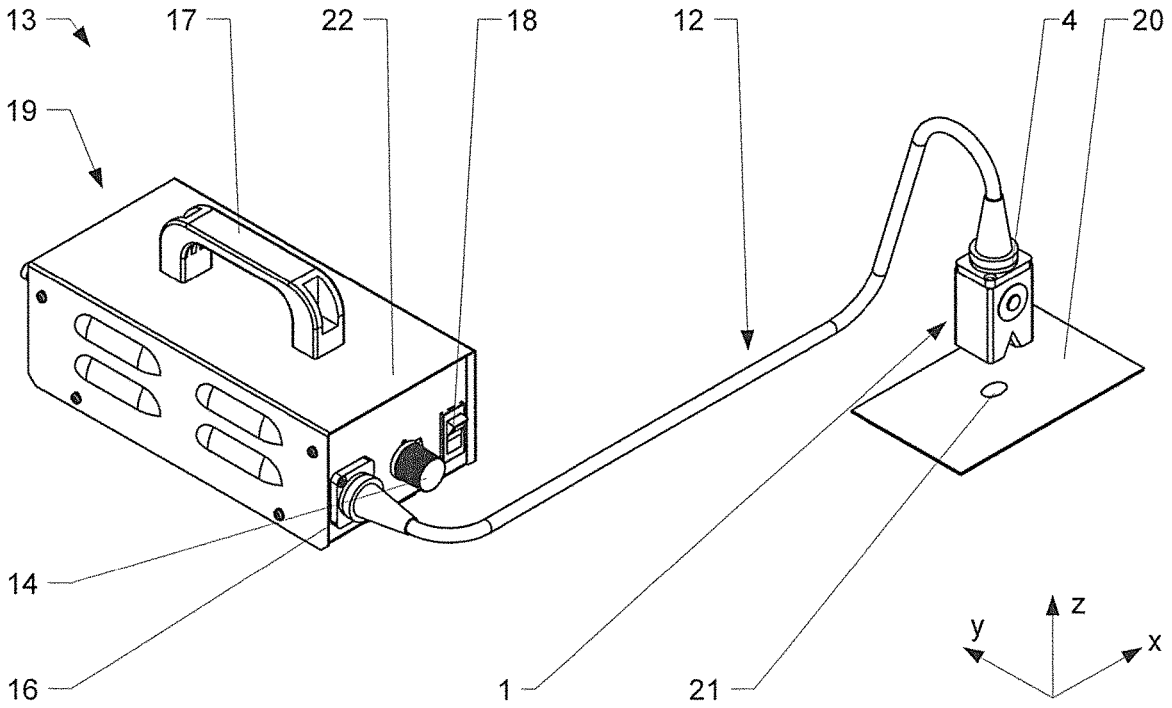
FIG. 1 schematically shows a device for removing dents in a perspective view from above.

FIG. 1 shows a device 13 for removing dents in sheet metal structures. The device 13 comprises a working head 1 and a power supply and control unit 19, which comprises a time regulating means and a power regulating means. The working head 1 comprises a housing 2 and a first connector 4 for connecting the electrical power to the working head 1. At the outer surface of a housing 22 of the power supply and control unit 19, operating means are arranged to operate the time regulating means and the power regulating means. For example, switches 14, which are operatively connected to the time regulating means and power regulating means, may be arranged in the outer surface of the housing 22 of the power supply and control unit 19 and time scalar and power scalar may be arranged around the switches at the surface of the housing 22. By turning the switches to the corresponding time or power scalar, the duration of supplying the power and the power provided to the working head can be chosen. A handle 17 is mounted on the top surface of the housing 22 of the power supply and control unit 19 to facilitate the transport of the device. A second connector 16 is arranged at the housing 22 of the power supply and control unit 19. The first connector 4 of the working head 1 is connected with the second connector 16 of the power supply and control unit 19 by a cable 12.

Figure 2:
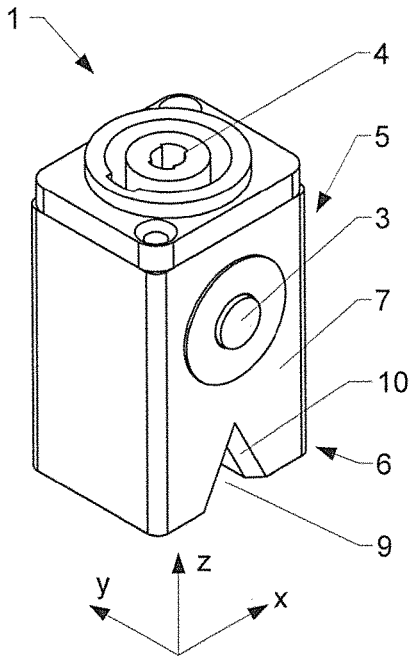
FIG. 2 shows one embodiment of a working head in a perspective view from above.
Figure 3:
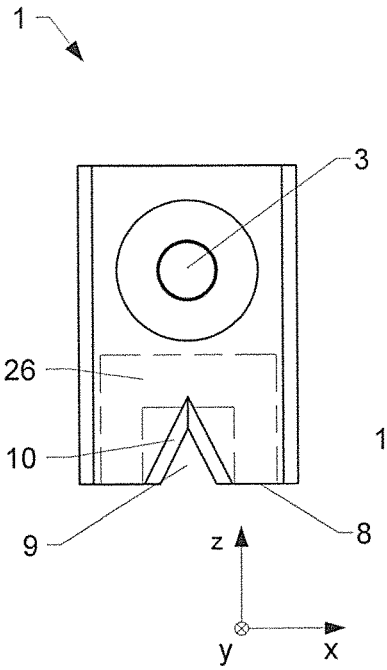
FIG. 3 shows the working head of FIG. 2 from the front.
Figure 4:
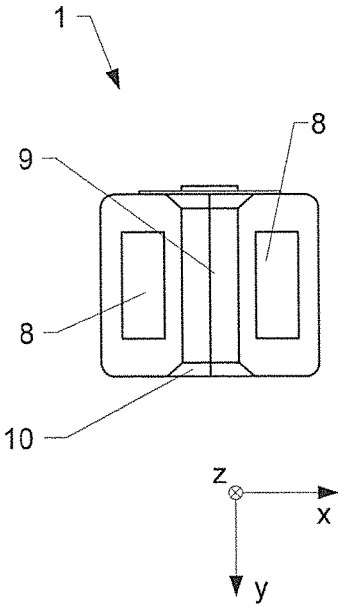
FIG. 4 shows the working head of FIG. 2 from the bottom.
Figure 5:
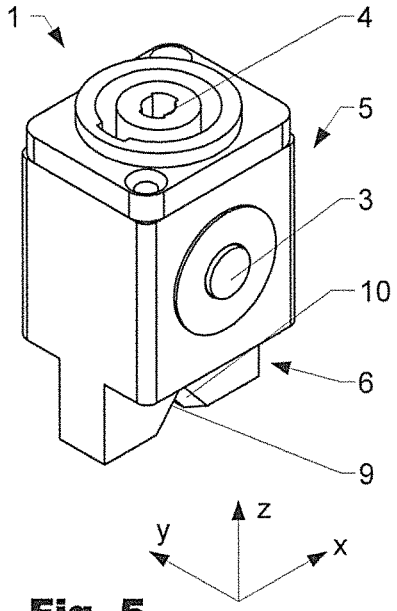
FIG. 5 shows another embodiment of a working head in a perspective view from above.
Figure 6:
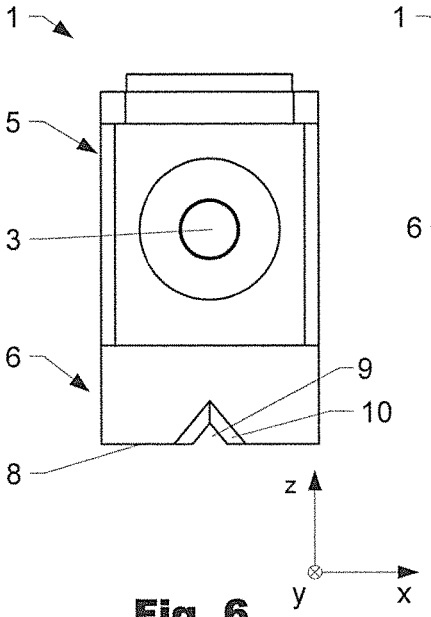
FIG. 6 shows the working head of FIG. 5 from the front.
Figure 7:
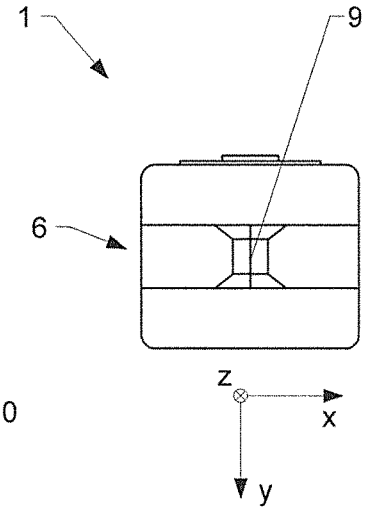
FIG. 7 shows the working head of FIG. 5 from the bottom.
Figure 8:
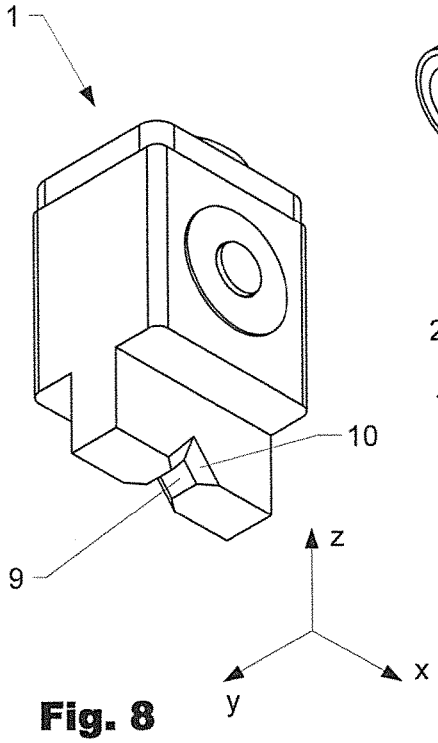
FIG. 8 shows the working head of FIG. 5 in a perspective view from the below.

FIGS. 2, 3 and 4 show one embodiment of a working head 1 according to the invention. The housing 2 of the working head 1 comprises several side walls, a top portion 5 and a bottom portion 6. The working face 8, which is arranged at the bottom portion 6, being at least partially in contact with the sheet metal 20 during the removing process. As illustrated in FIG. 3, a recess 9 is arranged at the bottom portion 6 of the housing 2. In a preferred variant, the recess 9 is arranged approximately in the middle of the working face 8. The recess 9 is formed as a groove. In particular, the recess 9 has a V-shape or U-shape with the wider opening at the working surface 8 of the housing 2. An activating means 3, e.g. a button is arranged at the housing 2 of the working head 1, in particular on one of the side walls of the housing 2. As indicated by dashed lines, the magnetic field generator may have a substantially U-shaped form, or comprise a U-shaped core 26. FIG. 4 shows a bottom view of the working head 1. As shown in the Figures, the recess 9 may comprise chamfers 10 which facilitate the visual inspection of a dent.

FIGS. 5, 6, 7 and 8 show another embodiment of the working head 1. This embodiment of the working head 1 differs from the embodiment mentioned above mainly in the shape of the housing 2 of the working head 1. In this embodiment, the dimension of the bottom portion 6 is smaller than the top portion 5. In particular, the diameter of the bottom portion 6 in y-direction is smaller than the diameter of the top portion 5.

Figure 9:
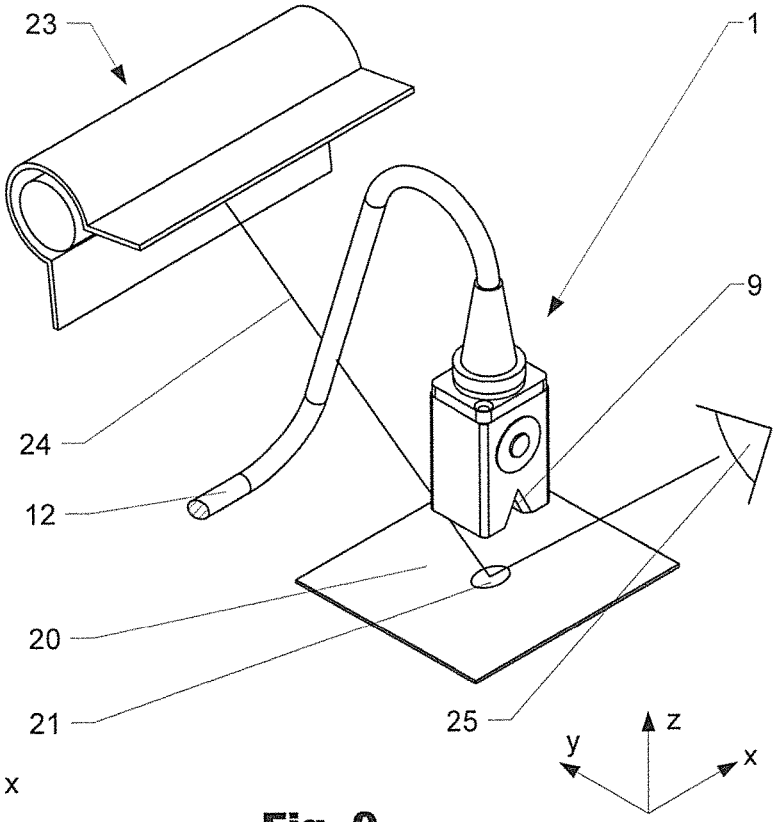
FIG. 9 shows a working head and a sheet metal with a dent in a perspective view.
Figure 10:
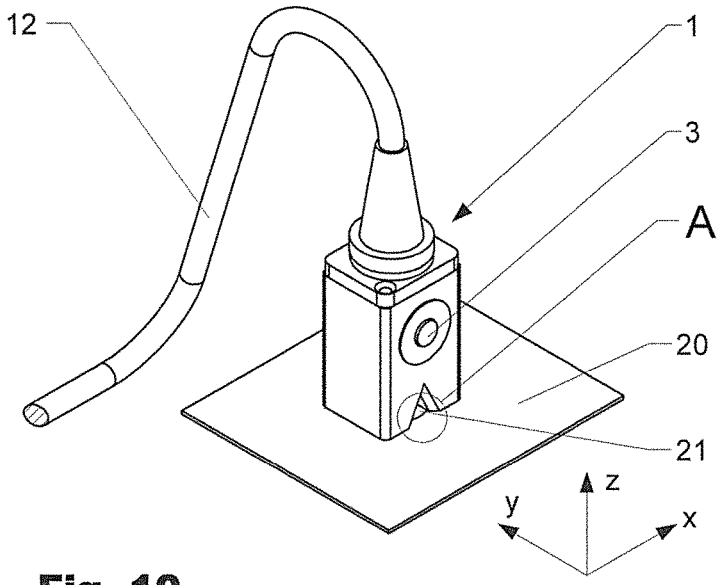
FIG. 10 shows a working head and a sheet metal with a dent in a perspective view.
Figure 11:
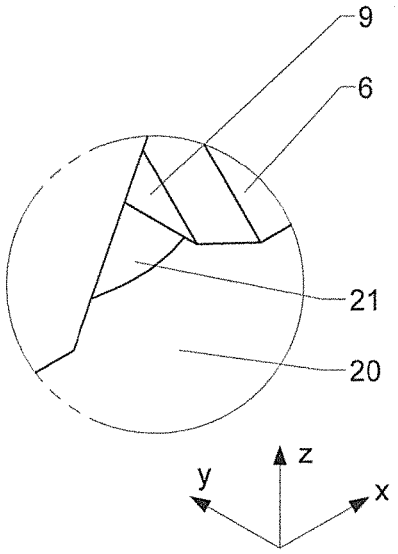
FIG. 11 shows detail A of FIG. 10.
Figure 12:
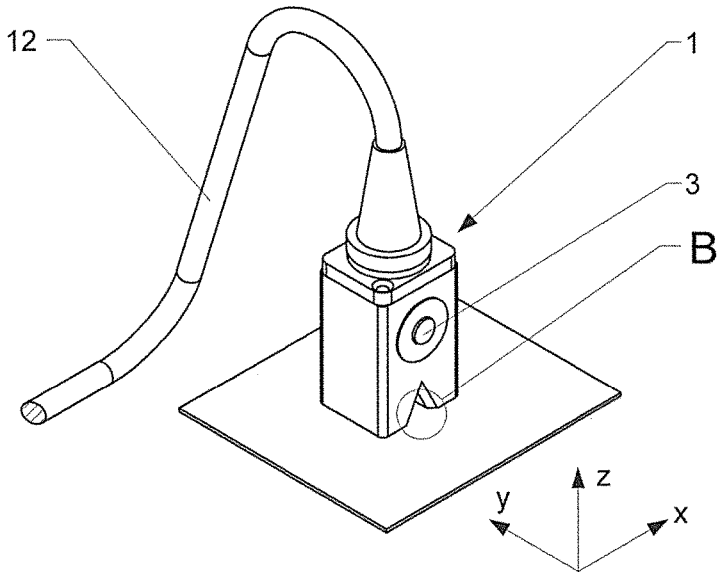
FIG. 12 shows a working head positioned on a sheet metal in a perspective view.
Figure 13:
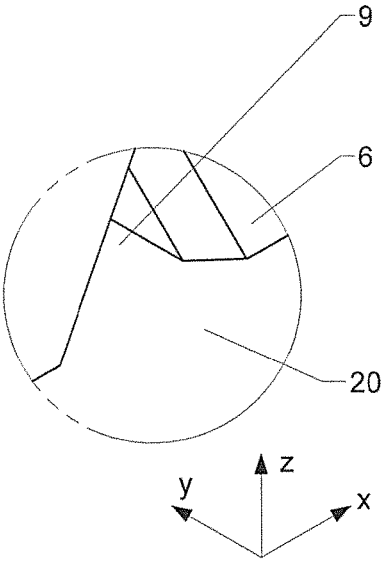
FIG. 13 shows detail B of FIG. 12.
Figure 14:
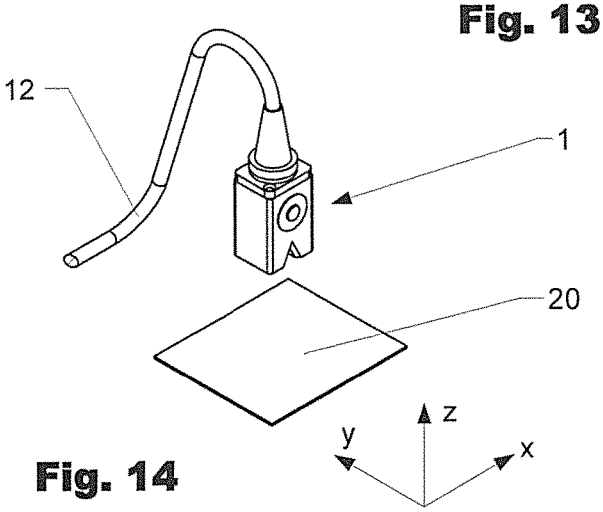
FIG. 14 shows a working head and a sheet metal in a perspective view.

FIGS. 9, 10, 12 and 14 show different positions of the working head 1 relatively to the dent 21 in the sheet metal 20 and illustrate the different states of the dent removing process. In FIG. 9, before starting the dent removing process the working head 1 is above the dent 21 and the cable 12 is connected to the first connector 4 for electrical power supply. As can be seen, the working area of the sheet metal structure 20 is illuminated by sided light, which comprises an elongated light source 23. The light radiated be the light source 23 is reflected by the sheet metal structure 20. At the dent 21, light is reflected (resp. deflected) in a very specific manner that differs from the deflection in the adjacent regions without dent. Such disturbed light paths 24 help an operator to spot a dent 21. In FIG. 10, the working face 8 of the housing 2 of the working head 1 is brought into contact with the sheet metal 20 and the recess 9 has approximately the same position in x and y-directions as the dent 21. Thanks to the recess 9, the light path 24 form the light source 23 to the dent 21 and the operator's eye 25 (not shown) is not interrupted and hence the dent 21 is still clearly visible for the operator. FIG. 11 is an enlarged view of detail A of FIG. 10. It illustrates that the dent 21 is not fully covered by the working head and thus visible to an operator, because the recess 9 serves as a viewing window. FIG. 12 illustrates the end of the dent removing process. FIG. 13 is an enlarged view of the detail B of FIG. 12 and illustrates the situation after a successful removal of the dent. As shown in FIG. 14, after the dent removing process the working head 1 will be removed from the sheet metal 20.

We claim:

1. A device for removing dents in sheet metal structures by inductive heating comprising:

a. a working head including a housing with at least one working face to be brought in close contact with a dent in a sheet metal;

at least one magnetic field generator for generating a magnetic field, wherein the magnetic field generator comprises an electrical coil, wherein the magnetic field generator comprises a substantially U shaped core, said core comprising a first and a second leg and a yoke portion wherein the electrical coil is interconnected to the core; and b. a power supply and control unit; and c. a cable suited to connect the power supply and control unit with the working head;

wherein the power supply and control unit comprises:

d. a time regulation means to control the duration of supplying the power to the working head; and e. a power regulation means to control the power supplied to the working head.

2. The device of claim 1 wherein the housing further includes a recess for visual control of the dent removing process.

3. The device of claim 2 wherein the recess extends at least partially across the at least one working face to divide the working face into at least two sections separated by the recess to permit visual inspection of the dent removing process.

4. The device of claim 2, wherein the recess has a V- or U-shaped cross section.

5. The device of claim 1, wherein the working head comprises more than one working face.

6. The device of claim 5, wherein each working face comprises a related magnetic field generator.

7. The device of claim 6, wherein each working face includes a differently configured recess.

8. The device of claim 1, wherein an activating means is arranged at the housing, said activating means being suited to control the magnetic field.

9. The device of claim 1, wherein at least one of a vibration generating means, an acoustic signal generator, and a visual display unit is integrated in the working head.

10. The device of claim 5, wherein the first and/or second leg have a cross-section with a minimum diameter of between 4 and 10 mm, preferably between 6 and 9 mm.

11. The device of claim 1, wherein the time regulation means can be set at a minimum of 0.5 seconds.

12. The device of claim 1, wherein an area of the sheet metal being treated by the device is inductively heated.

13. A device for removing dents in sheet metal structures by inductive heating comprising:

a working head having a housing with at least one working face to be brought in close contact with a dent in a sheet metal;

at least one magnetic field generator comprising an electrical coil for generating a magnetic field, wherein the magnetic field generator comprises a substantially U shaped core, said core comprising a first and a second leg and a yoke portion wherein the electrical coil is interconnected to the core; and a power supply and control unit having a time regulation means to control the duration of supplying the power to the working head and a power regulation means to control the power supplied to the working head.

* * * * *